United States Patent [19]

Smith et al.

[11] 4,451,018

[45] May 29, 1984

[54] NON CONTACT ISOLATED CURRENT DETECTOR

[75] Inventors: Barry L. Smith; William A. Petit, both of Rochester, N.Y.

[73] Assignee: General Signal Corporation, Stamford, Conn.

[21] Appl. No.: 356,080

[22] Filed: Mar. 10, 1982

[51] Int. Cl.[3] ..... B61L 25/00; B61L 21/00

[52] U.S. Cl. ..... 246/122 R; 246/34 R; 246/34 A; 246/28 F; 246/249

[58] Field of Search ..... 246/122 R, 34 R, 34 A, 246/34 B, 28 F, 249, 125, 128, 130

[56] References Cited

U.S. PATENT DOCUMENTS

| | | | |
|---|---|---|---|
| 3,470,370 | 9/1969 | Landow | 246/122 R |
| 3,526,378 | 9/1978 | Thorne-Booth | 246/122 R |
| 3,891,167 | 6/1975 | Perry | 246/122 R |
| 4,415,134 | 11/1983 | Wilson | 246/34 B |

*Primary Examiner*—James J. Groody

*Attorney, Agent, or Firm*—Pollock, Vande Sande & Priddy

[57] ABSTRACT

A receiver for sensing track currents includes a toroid coupled to the track rails via a single conductor. The toroid has an air gap in which a linear Hall sensor is inserted. The voltage of the Hall sensor is applied to signal processing circuitry including a low pass filter, amplifier and level detectors. In one embodiment of the invention comprising a track occupancy detector, second and third windings coupled to the toroid are selectively energized from a potential source to provide MMF's in the toroid of one and another polarity, and of a level less than the MMF provided by an occupied track section. The amplifier includes first and second channels for amplifying signals of opposite polarities. Each channel of the amplifier is coupled to a pair of level detectors, one of the level detectors in each pair is a vital level detector with the threshold set at about 50% of the threshold of the other level detector in the pair. A lack of occupancy is indicated when, during normal operation, level detectors trip in pairs. Lack of failures is checked by opening the conductor to the track rails and sequentially energizing the second and third conductors, and noting that one level detector in each pair trips in response to energization of the second or third conductors, respectively. Another embodiment of the invention is used as an approach detector by comparing current level in the rails with a fixed threshold, as current increases above the threshold an approach indication is given.

7 Claims, 6 Drawing Figures

NON CONTACT ISOLATED CURRENT DETECTOR

DESCRIPTION

1. Technical Field

The invention relates to track circuits and more particularly provides a novel receiver sensitive to track circuit current variations, which can be used as an approach detector or as an occupancy detector.

2. Background Art

The DC track circuit, the invention of which made it possible to automate train signalling and control functions, is more than 100 years old. A further advance was made to increase the sensitivity of the DC track circuit by the invention of the coded circuit. In the DC track circuit, a potential difference is placed across a pair of track rails which generates current flow in a relay connected at another location. The current flow in the relay serves to close the relays front contacts. Presence of a train shorts out the relay and ensures that the front contacts of the relay are open. This is used as an indication that a train is present somewhere between the location at which the potential difference is connected and the location at which the relay is connected. The coded track circuit uses, instead of direct current, pulsating direct current (quasi-DC) to increase the sensitivity of the indication.

Besides using a relay as an occupancy detector in a DC coded track circuit, the relay has also been used in DC coded track circuits as an approach detector. In the latter function, the approach detecting relay is located at the same position as the application of potential to the track rails. As a result, the short produced by the vehicle, since it is removed from the approach detecting relay, does not remove energy from the approach detector, rather by reducing the impedance seen at the point of application of potential, the current level at the approach detector is increased. This increase in current level is used to signal an approaching train.

While this combination has served the industry remarkably well for a long time, it is now desired to replace the relay as an element used for occupancy and approach detection purposes. The reason for the desire to replace the relay relates to maintenance requirements. Because it is a mechanically moving element, it does have a limited lifetime and furthermore requires periodic maintenance.

Typically, combinations of relays are employed to perform different logic functions; replacing the logic functioning of the relay combinations with commercially available microprocessors is inadequate to totally replace the relay in its functioning as a detector of vehicles. In the DC coded track circuit detecting of the absence of a vehicle required the device (which hereinafter will be referred to as a receiver) to determine that it is periodically receiving electrical current in excess of some threshold, and that this current is periodic and not constant. Furthermore, in order to maintain reasonably sized track sections (that is where the potential source is removed from the receiver by a distance on the order of thousands of feet), the receiver must be capable of detecting the periodic presence and absence of currents, on the order of 1.0 ampere, in the presence of noise or spurious currents. The track relay in the coded track circuit was self-checking in that if the relay did not change state at the appropriate rate, failure was readily detected. Of course, it is desirable for a replacement device to exhibit equivalent characteristics. It is therefore one object of the present invention to provide a novel receiver for DC coded track circuits which does not rely on the characteristics of the electromagnetic relay for current detection. It is another object of the present invention to provide an improved track circuit for a DC coded track current in which the presence of the track relay has been eliminated. It is another object of the present invention to provide a receiver in a DC coded track circuit which is capable of safely being relied on as an occupancy detector, i.e. to meet or exceed the safety characteristics exhibited by the track relay. It is another object of the present invention to provide a receiver for a DC coded track circuit which can be employed as an approach detector, i.e. a device which can reliably distinguish current levels to detect an approaching vehicle.

SUMMARY OF THE INVENTION

These and other objects of the invention are met by eliminating the electromagnetic relay in a DC coded track circuit and in its place providing a toroidal core made up of a magnetic material such as Silectron, which is coupled to the track rails via a conductor. The toroid includes an air gap in which is a Hall sensor, sensitive to the magnetomotive force induced in the toroid as a result of current flowing in the track rails. The current in the track rails is magnetically coupled to the toroid via the mentioned conductor. Preferably the Hall sensor has a linear characteristic. The voltage produced by the Hall sensor can, in one embodiment of the invention be used to indicate lack of occupancy, when the conductor which couples the track rails and toroid is located at a point removed from application of a potential difference to the track rails, and in another embodiment of the invention can be used as an approach detector, when the mentioned conductor is coupled to the track rails at the point of application of the potential difference.

Accordingly, the invention provides:

a DC circuit sensitive to current variations comprising:

a quasi-DC pulse source of current coupled to a pair of track rails, a current sensitive receiver coupled to said pair of track rails, said current sensitive receiver comprising:

a toroidal core with an air gap, said core coupled to said track rails via a single conductor, a Hall sensor located in said air gap to sense a magnetic field induced in said core by current coupled from said track rails, operational amplifier means for amplifying a signal emitted by said Hall sensor, and level detector means coupled to said operational amplifier means for producing a distinctive output signal in the event an input signal to said level detector means exceeds a threshold established by said level detector means, whereby changes in current level in said track rail produce distinctive outputs from said level detector means as said signal emitted by said Hall sensor varies above and below the threshold established by said level detector means.

In a first embodiment of the invention in which the receiver is used as an occupancy detector, the conductor is connected across the track rails at a location spaced from the pulse source of current; and lack of occupancy is indicated so long as a distinctive output is produced by the level detector. In a coded track circuit, the level detector output periodically changes; and this operation is checked in a vital fashion.

In another embodiment of the invention, wherein the receiver is used as an approach detector, the conductor is coupled to the track rails at the same location as is the pulse current source. In this embodiment of the invention the level detector means is arranged to set a threshold which is normally not exceeded by the input voltage to the level detector in the absence of a train. The presence of a train, in reducing the impedance seen by the pulse source, however, results in an increase in current flowing in the track rails; this increase in current is reflected in an increase in the voltage input to the level detector which therefore provides a distinctive output indicating the approaching train.

BRIEF DESCRIPTION OF THE DRAWINGS

The present invention will now be further described in the following portions of the specification taken in conjunction with the attached drawings in which like reference characters identify identical apparatus and in which.

DETAILED DESCRIPTION OF PREFERRED EMBODIMENTS

Figure 1A:
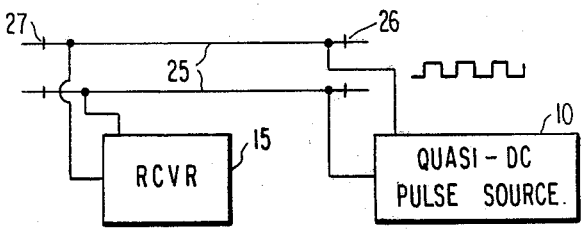
FIGS. 1A and 1B are respectively schematic showing typical use of a track circuit occupancy detector and a block diagram of an embodiment of the invention for use as an occupancy detector.

FIG. 1A is a schematic illustrating use of an embodiment of the invention as an occupancy detector. As shown in FIG. 1A a quasi-DC pulse source 10 supplies a pulse train waveform to a pair of track rails 25 located between pairs of insulated joints 26 and 27. As a result of the potential difference supplied to the track rails 25 by the source 10, current flows through the track rails and into a receiver 15 connected across the same track rails 25. In the event that a railroad vehicle occupies the track section 25, the vehicle will typically short the two rails together inhibiting current flow in the receiver 15. This lack of current flow is used to indicate occupancy. Furthermore, the pulsating nature of the potential difference results in a pulsating current in the receiver 15 when the track section 25 is unoccupied, which can readily be differentiated from a steady current.

Figure 1B:
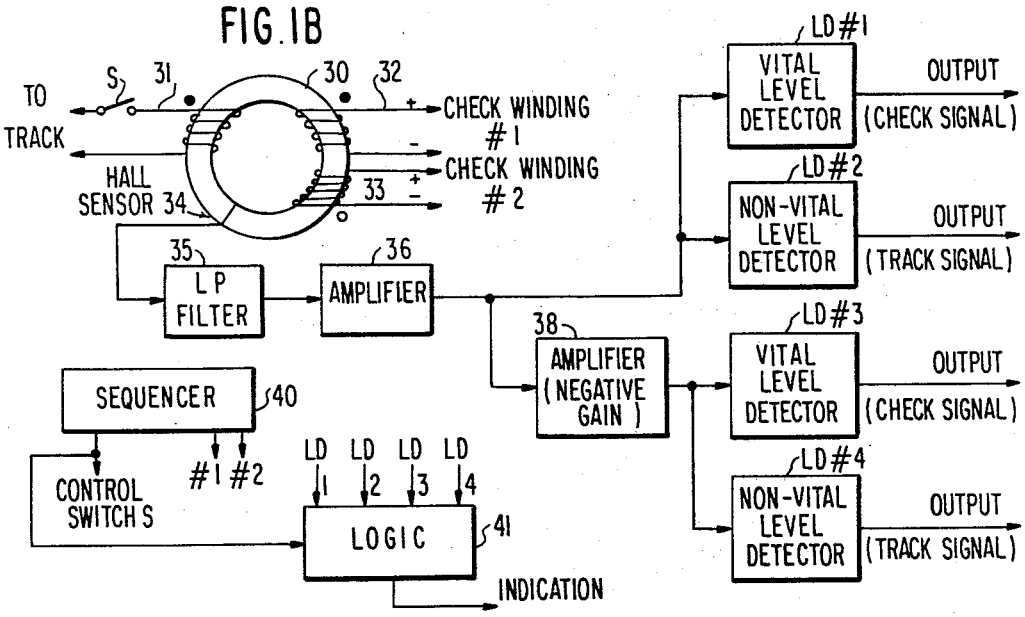

A block diagram of the receiver 15 is shown in FIG. 1B, which, as should be apparent, does not include any electromagnetic relays for current detection. More particularly, as shown in FIG. 1B, a toroid 30 is coupled to three conductors, a first conductor 31 is coupled to the track rails via a switch S, a second conductor 32 is coupled to a voltage supply (this is check winding #1), and a third conductor 33 is coupled to the supply but wound in the opposite sense from check winding #1 (this is check winding #2). The polarity of the check windings 1 and 2 or the sense of windings #1 and #2 are opposite each other. As a result of either technique, the MMF induced in toroid 30 is of opposite senses depending on whether winding #1 or #2 is energized. An air gap in the core 30 has a Hall sensor located therein to respond to the MMF induced in the core 30 as a result of current flowing in any of the conductors 31–33. The Hall sensor 34 provides an output voltage to a low pass filter 35 (used to remove power line harmonics and the like) with an output coupled to an amplifier 36. The amplifier 36 is coupled to two output channels, a first positive channel outputs to level detectors LD #1 and LD #2. A second channel comprising the other output channel of amplifier 36 is coupled to an amplifier 38 with a negative gain. Accordingly, while the polarity of the input to LD #1–4 is identical, the input to LD #1 and LD #2 represents curent in the track rails in a first direction and the output of amplifier 38 represents current flow in the opposite direction. The output of amplifier 38 is coupled to the other pair of level detectors LD #3 and LD #4.

In addition to the foregoing apparatus, a sequencer 40 provides three output signals, a first to control the switch S, a second to enable a voltage to be applied to check winding #1, and a third to enable a voltage to be applied to check winding #2. The outputs of the level detectors LD #1–LD #4 are provided to a logic circuit 41 which is able to provide an indication relative to the occupancy condition of the section of track rails 25. Furthermore, however, by reason of the level detectors LD #1–LD #4, the check windings 1 and 2 and the logic circuit 41, the indication provided is vital in that potentially unsafe failures in any of the components shown in FIG. 1B are detected so that when a lack of occupancy indication output is provided, the user is assured that unsafe failures have not falsely produced a lack of occupancy indication.

As should be apparent to those skilled in the art, current level in the rails results in a current flowing in conductor 31. This current induces an MMF in the core 30, and the same is sensed by the Hall sensor producing an output representative thereof. The Hall sensor 34 is of the linear type in which the output voltage is proportional to the MMF, over a given range. The linearity in the relation between track current and voltage is maintained through the filter and amplifiers, so that the input voltage to the level detectors LD #1–2 (for positive currents) and LD #3–4 (for negative currents) is representative of the track current. One level detector in each pair (for example LD #2 in the first pair and LD #4 in the second pair) has a threshold set at the current level indicative of lack of occupancy. Accordingly, when level detector #2 is tripped the output signal is indicative of the fact that the positive current in the track rails indicates lack of occupancy of the track section. In a similar fashion, when level detector LD #4 is tripped, it is indicative of the fact that the negative track current is indicative of lack of occupancy.

Failures in the level detectors (or even in the attached apparatus), for example a decrease in the tripping threshold, could lead to a false lack of occupancy indication. To this end, check windings #1 and #2, the level detectors LD #1 and LD #3 are provided. The latter two level detectors are firstly vital level detectors of a known design (meaning that decrease in the threshold is extremely unlikely) and the thresholds are set to be below the thresholds for the other two level detectors, for example about 50% below. Furthermore, the voltage supplied to the check windings #1 and #2, taken in conjunction with the number of turns in these windings, is arranged so that the MMF in the core 30

(and the corresponding voltage output of the Hall sensor 34) in response to check winding currents is sufficiently below that produced during a lack of occupancy condition, that neither of the level detectors #2 or #4 trips (in the absence of unsafe failures) but that the level detectors #1 and #3 will be tripped. As a result, when MMF of a first polarity (for example current flowing in winding #1) is produced, LD #1 is tripped and LD #2 is not; this can be used to prove that the threshold of LD #2 has not decreased. Similar proof is provided for MMF of the other polarity, when LD #3 is tripped and LD #4 is not. To ensure that the checking operations are not interferred with by currents flowing in the track rails themselves, when checking is occurring the switch S is open.

As a result, when the logic circuit 41 sees, during normal operation LD's 1–4 are tripped (in pairs, that is LD #1 and LD #2 and later LD #3 and LD #4), and during a checking operation LD's 1 and 3 tripped (in time sequence) and LD's 2 and 4 not tripped, a safe indication of lack of occupancy can be provided.

Figure 1C:
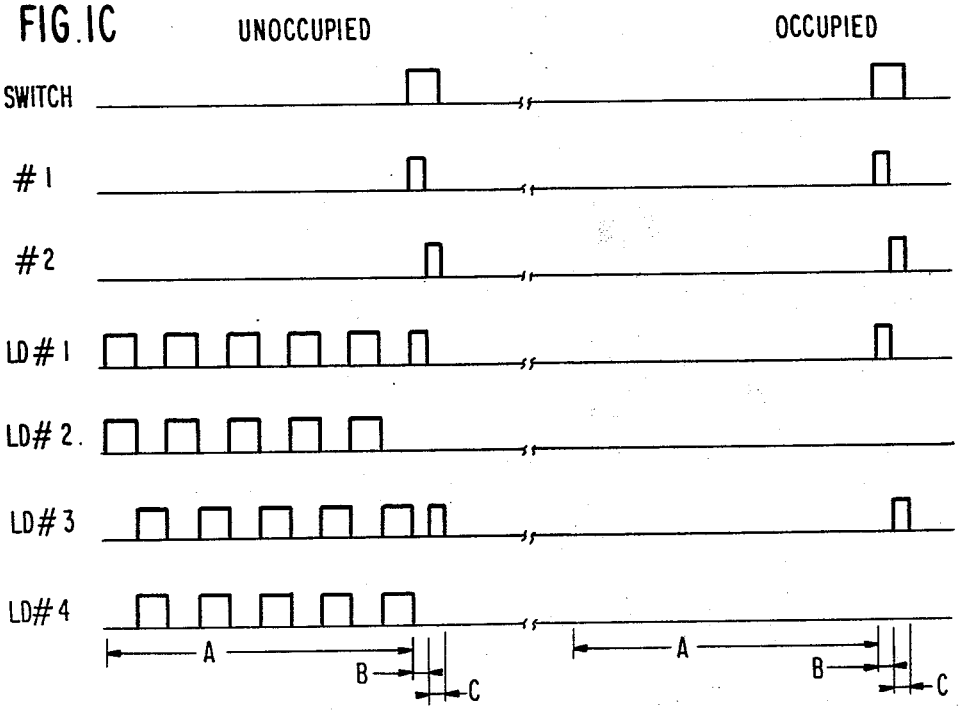
FIG. 1C is a timing diagram of typical operating states.

FIG. 1C represents one cycle of operation for occupied and unoccupied conditions. FIG. 1C represents, in lines #1 and #2, current pulses flowing in check windings 1 and 2, respectively, on lines LD 1–4 the tripped or untripped condition of the associated level detector (a tripped level detector is indicated by a positive pulse, an untripped level detector is indicated by the absence of a pulse) and on the line labelled switch, the condition of the switch S, where the pulse represents an open switch. Passage of time is represented on the horizontal axis. For purposes of this description, a cycle of operation includes time segments A, B and C; and FIG. 1C shows two cycles, a first cycle occurring when the track section is unoccupied, a second occurring when the track section is occupied. In the first cycle of operation, with the switch S closed (segment A) the level detectors are tripped in pairs, that is when level detectors 1 and 2 are tripped, level detectors 3 and 4 are not, and vice versa. This is as a result of the currents in the track rail being coded or pulsating as described in copending application entitled Microprocessor Based Track Circuit for Occupancy Detection and Bidirectional Code Communication, Ser. No. 356,861, filed simultaneously herewith and assigned to the assignee of this application. At the conclusion of time period A, the checking period occurs. In time period B positive MMF is applied to the core and thus LD #1 is tripped, and LD's #2–4 are not. Tripping of LD #1 and the absence of tripping of LD #2 is indicative of the absence of an unsafe failure in LD #2. During time period C an opposite MMF is applied; LD #3 is tripped and LD's #1, #2 and #4 are not. This provides similar proof.

In the second cycle of operation (for an occupied condition) none of the level detectors are tripped in the time period A whereas the same checking operation occurs in periods B and C. The occupancy indication need not be verified inasmuch as if the indication is itself a failure, it is a safe failure.

In an embodiment of the invention which has been constructed, the occupancy detector or receiver shown in FIGS. 1A and 1B is part of a transmitter/receiver (T/R) and the switch corresponding to the switch S is open during the transmissions from the transmitter part of the T/R. The checking operation occurs just after the transmission, and while the switch S remains open. This is described in more detail in the above-referenced application, which is hereby incorporated by reference. Furthermore, in that same application the sequencer 40 and logic circuit 41 are more completely disclosed as comprising a microprocessor. Since the sequencer 40 and logic circuit 41 can be constructed using a number of available technologies known to the art, no further description is required herein.

Figure 1D:
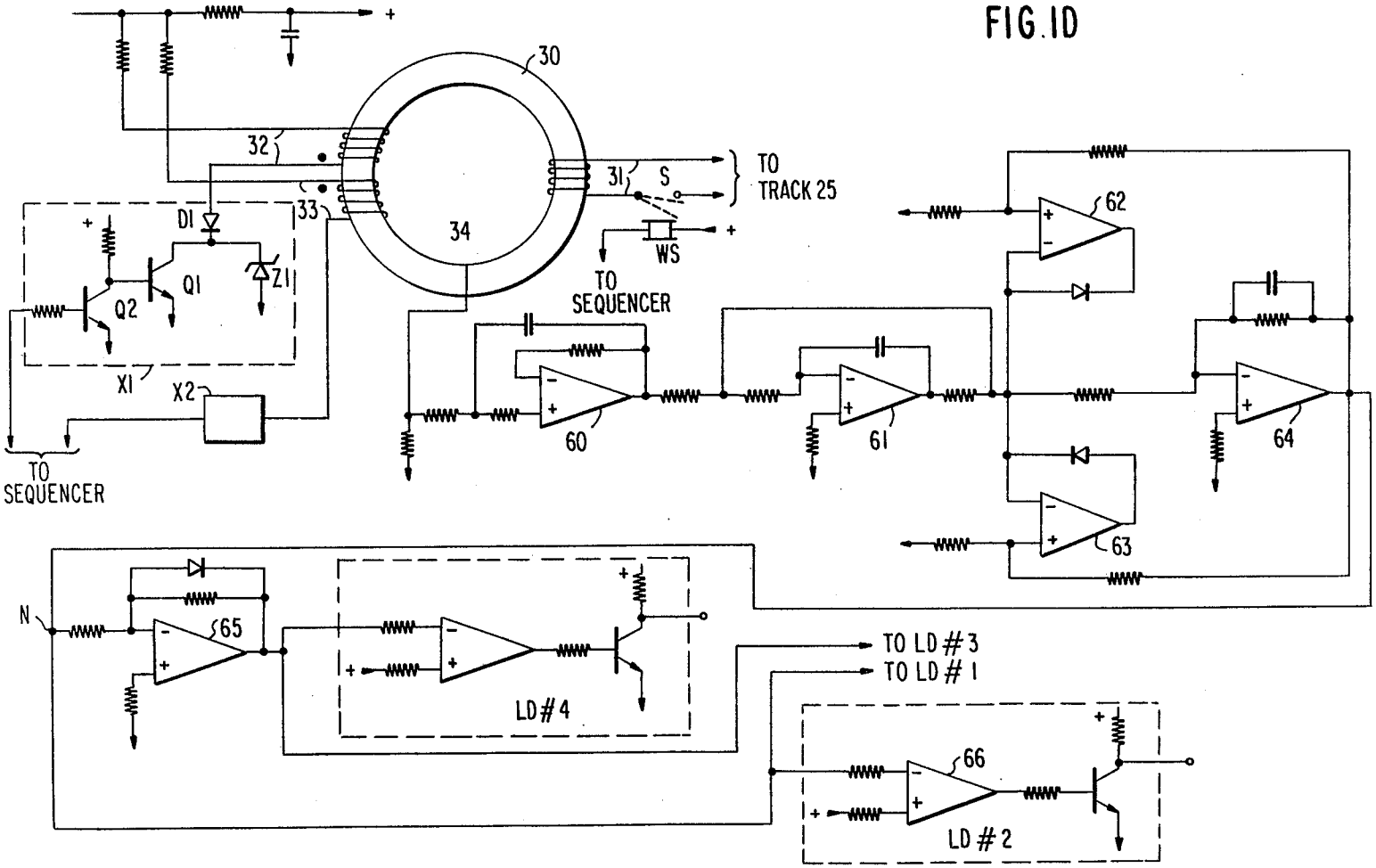
FIG. 1D is a schematic corresponding to the block diagram of FIG. 1B.

FIG. 1D is a schematic of one embodiment of the invention. As shown in FIG. 1D, a positive source of potential is coupled to one end of each of the conductors 32 and 33; the dot convention illustrates the opposed senses of the windings. The other end of each of the conductors is coupled via a switch, x1 for conductor 32 and x2 for conductor 33 to the sequencer 40 (of FIG. 1B). FIG. 1D shows representative switch x1 in more detail as comprising a base driven transistor Q2 which is used to turn on transistor Q1 to allow current to flow from the source of potential through the conductor 32 to ground. Accordingly, when the base of Q2 is enabled, current can flow through conductor 32. In a simiar fashion, when the switch x2 is closed by the sequencer 40, current can flow through the conductor 33. FIG. 1D also shows the conductor 31 wound around the core 30 and connected to the track rails 25. Connected serially in the conductor 31 is the switch S, which is controlled from the sequencer 40. FIG. 1D illustrates a relay winding WS which is energized to close the switch S; and in this fashion the sequencer 40 controls the condition of the switch S. Those skilled in the art will understand that the particular control device (the electromagnetic relay WS) is not essential to the invention and any of a host of well known devices could be used to control the conductivity of the conductor 31; it is only preferable that conductivity be drastically decreased at periods of time when a check operation is to occur.

FIG. 1D also shows that the low pass filter is an active device including an operational amplifier 60 and associated passive circuitry. In addition the amplifier 36 comprises a quartet of operational amplifiers including operational amplifiers 61–64. Amplifier 61 is connected as an integrator, and amplifiers 62 and 63 are clamping circuits. This arrangement of amplifiers 61–63 are provided to compensate for the DC offset found in the Hall sensor 34. The integrator tracks the difference between supply and the DC offset, and provides an error voltage to cancel this out; the operational amplifiers 62 and 63 clamp the input voltage to the amplifier 64 to limit variations in its input. Of course, the clampling levels are set so that the level detectors following amplifier 64 can distinguish between current levels indicative of occupied track sections and current levels indicative of unoccupied track sections. The amplifier 64 is provided essentially for gain purposes. The output of the amplifier 62 is split at node N. The node N forms an input to an inverter 65 which performs the function of an isolation diode. The inverter 65 thus is the initial stage in the negative channel of the receiver. The node N also provides the input to the positive channel of the receiver comprising level detectors #1 and #2. Level detector #2 is shown in detail; comprising operational amplifier 66 and a transistorized current switch. The threshold at which LD #2 trips is determined by the positive input to the operational amplifier 66. The other level detector in the positive channel is not explicitly shown, however vital level detectors are well known to those skilled in the art. As mentioned above, the thresholds of level detectors in the positive channel are set differently, the vital level detector has a threshold which is below the threshold of LD #2; in one embodiment of the invention the thresholds differ by about 50%.

The negative channel of the receiver is, from the output of the inverter 65 on, essentially identical to the positive channel.

In an embodiment of the invention which has been constructed, the Hall sensor comprised a linear device identified as Microswitch 91SS12-2 which provides nominally 284 millivolts per ½ ampere of track current. The thresholds are set on the expectation that typical track currents for unoccupied track sections will be about ¾ ampere, with the thresholds, of LD's #2 and #4 set at levels corresponding to ½ ampere. In the mentioned embodiment, the various amplifier gains, number of turns in the conductor 31, etc. were arranged to trip level detectors 2 and 4 at 2.84 volts and level detectors 1 and 3 at 1.42 volts.

Figures 2A, 2B:
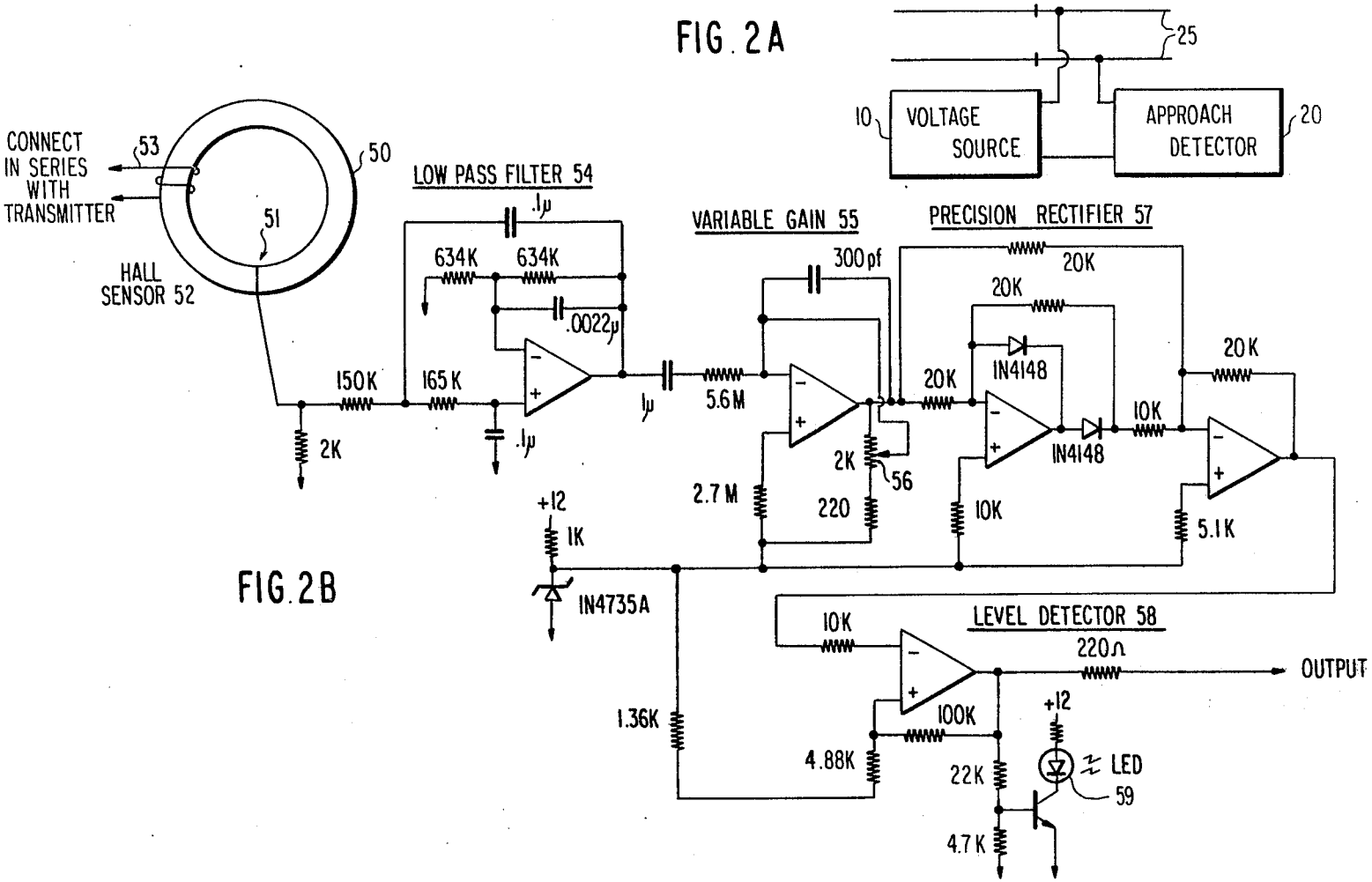
FIGS. 2A and 2B are respectively a schematic showing the use of a vehicle approach detector and a schematic illustrating a second embodiment of the invention comprising an approach detector.

FIGS. 2A and 2B illustrate another embodiment of the invention for performing an approach detection function. As shown in FIG. 2A, a voltage source 10, which may be the same source 10 as that shown in FIG. 1A, is connected to a pair of track rails 25 at a first location. Connected to the track rails 25 at substantially the same location is an approach detector 20, a schematic of the approach detector is shown in FIG. 2B. Typically the approach detector is connected in series with the source 10. When the voltage source 10 is active, in applying a potential difference across the rails 25, the approach detector 20 can detect an approaching vehicle by noting an increase in track current as the vehicle approaches and correspondingly reduces the impedance in the track rails 25 seen at the point of application of the voltage.

More particularly, referring to FIG. 2B, a toroid 50 is shown, which may be similar to the toroid 30 shown in FIG. 1B. The toroid 50 includes an air gap 51 in which a Hall sensor 52 is located. Hall sensor 52 can be similar to the sensor 34 of FIG. 1D. However, whereas the sensor 34 is tied to system source voltage, sensor 52 has its own regulated supply voltage. Wound around the toroid 50 is one or more turns of a conductor 53 whose ends are connected in series with a voltage source 10 across the track rails 25.

The output of the Hall sensor 52 is coupled as an input to a low pass filter 54, the output of which is coupled as an input to a variable gain amplifier 55. The gain of the amplifier 55 is adjusted via the potentiometer 56. The output of the amplifier 55 is coupled as an input to a two stage operational amplifier precision rectifier 57. Whereas the output of the Hall sensor is an alternating voltage proportional to the MMF in the core 50, the output of the precision rectifier is a filtered, amplified and rectified version of the Hall sensor output voltage. The output of the precision rectifier 57 is provided as one input to a level detector 58. The other input to the level detector 58 is provided by a voltage divider from a control voltage source. The level detector 58 compares the voltages and provides a distinctive output in the event that the one input from the precision rectifier 57 is above the level set by the potential divider. This output is taken at the terminal labelled "output". In addition, an LED indicator 59 is provided to give a visible indication when the precision rectifier 57 output voltage exceeds the threshold established by the potential divider.

In operation, when the source 10 is enabled, current flows through the conductor 53, since it is in series with the source 10. In the absence of a vehicle in the section of track to which the source 10 and detector 20 are connected, the current flowing through the conductor 53 will produce an MMF in the core 50 which results in a voltage output of the Hall sensor 51 which, after processing in the circuitry of FIG. 2B, is below the threshold established at the level detector 58. The threshold of the level detector 58 is set such that the foregoing statement is true notwithstanding the known variations in track current caused by weather conditions and the like. As a result, in the absence of an occupied track section, the output of the level detector will distinctively indicate the lack of an approaching vehicle.

On the other hand, when the track section is occupied, as the vehicle travels toward the source 10, the impedance presented to the source 10 by the combination of track rails and approaching vehicle is constantly decreasing. As a result, and as should be apparent to those skilled in the art, the current travelling in the track rails 25 increases; since this same current flows through conductor 53, the MMF in the core 50 increases. The threshold of level detector 58 is selected such that it is below the expected current level for a vehicle which is within a given distance of the track connections. Although this trigger distance will vary depending on weather conditions, the threshold is set such that the approaching vehicle will produce current of such a level that the input to the level detector 58 will exceed the threshold. Under these circumstances the output of the level detector 58 changes state, to indicate the presence of an approaching vehicle. The output of the level detector 58 remains in this changed state until after the vehicle has passed out of the track section resulting in a relatively abrupt impedance increase and reduction in current.

It should be noted that the approach detector of FIGS. 2A and 2B is not protected by the checking techniques used in connection with FIGS. 1A–1D, for example. Because of this the approach detector output cannot be considered vital, and a review of the referenced copending application will reveal that under certain circumstances the indication given by the approach detector is ignored. Of course if desired the same checking techniques can be applied to the level detector 20.

We claim:

1. A DC track circuit sensitive to current variations comprising:

a quasi-DC pulse source of current coupled to a pair of track rails, a current sensitive receiver coupled to said pair of track rails, said current sensitive receiver comprising:

a toroidal core with an air gap, said core coupled to said track rails via a single conductor, a Hall sensor located in said air gap to sense a magnetic field induced in said core by current coupled from said track rails, operational amplifier means for amplifying a signal emitted by said Hall sensor, and level detector means coupled to said operational amplifier means to emit a distinctive signal in the event that an input to said level detector means exceeds a threshold established at said level detector means, whereby changes in current level in said track rail produce distinctive outputs from said level detector means as said signal emitted by said Hall sensor varies above and below the threshold established by said level detector means.

2. The DC track circuit of claim 1 in which said pulse source is connected across said pair of track rails at a first location, said current sensitive receiver is coupled across said pair of track rails at a second location, spaced along said track rails from said first location, whereby decreases in current level in said single conductor produce a distinctive output from said level detector means as said signal emitted by said Hall sensor decreases below a threshold established by said level detector means to thereby indicate occupancy of a section of track defined between said first and second location.

3. The apparatus of claim 2 which further includes at least a second conductor magnetically coupled to said toroidal core and coupled to a switched source of voltage, wherein said level detector means comprises a first level detector and a second level detector, said first level detector having a threshold different from a threshold of said second level detector.

4. The apparatus of claim 3 wherein said first level detector is a vital level detector and has a threshold about 50% of a threshold of said second level detector.

5. The apparatus of claim 2 which further includes:

a second and third conductor each magnetically coupled to said toroid in opposite senses, a pair of switches, each connecting one of said second and third conductors to a potential source, and wherein said operational amplifier means includes first channel means for amplifying signals of one polarity and second channel means for amplifying signals of an opposite polarity, said level detector means includes two pairs of level detectors, a first pair coupled to said first channel means and a second pair coupled to said second channel means, each pair of level detectors including a single vital level detector with threshold below the threshold of the other level detector of said pair, whereby lack of occupancy is indicated by pairs of level detectors tripping and safe operation is checked by closing first one and then the other of said pair of switches and noting the tripping pattern of said level detectors.

6. The apparatus of claim 5 wherein said potential source, number of turns of said second and third conductors and thresholds of said level detectors is selected to ensure that one and not the other level detector of each pair is tripped in response to energization of said second and third conductors.

7. The apparatus of claim 1 wherein said pulse source and current sensitive receiver are coupled in series across a pair of track rails whereby increases in current level in said track rail produce a distinctive output from said level detector means as a signal emitted by said Hall sensor varies above the threshold established by said level detector means to indicate a vehicle approaching said source and receiver.

* * * * *